United States Patent [19]

Schrimpf

[11] Patent Number: 4,712,945

[45] Date of Patent: Dec. 15, 1987

[54] SYSTEM FOR SEALING BARRIER CONSTRUCTIONS IN SUBTERRANEAN GALLERIES

[75] Inventor: Christian Schrimpf, Hildesheim, Fed. Rep. of Germany

[73] Assignee: Leine & Konig, Fed. Rep. of Germany

[21] Appl. No.: 758,214

[22] Filed: Jul. 23, 1985

[30] Foreign Application Priority Data

Jul. 28, 1984 [DE] Fed. Rep. of Germany ..... 3427978

[51] Int. Cl.[4] ..... E21D 9/14; E21F 17/00

[52] U.S. Cl. ..... 405/132; 299/12; 405/267

[58] Field of Search ..... 405/132, 267; 299/2, 299/10, 11, 12, 19; 405/265

[56] References Cited

U.S. PATENT DOCUMENTS

| | | | |
|---|---|---|---|
| 3,927,719 | 12/1975 | Maser | 405/267 X |
| 3,934,219 | 1/1976 | Monaghan | 405/132 X |
| 4,076,312 | 2/1978 | Cha et al. | 299/2 |
| 4,102,138 | 7/1978 | Dreker et al. | 299/12 X |
| 4,289,354 | 9/1981 | Zakiewicz | 299/2 X |
| 4,315,657 | 2/1982 | Burton | 299/2 |

FOREIGN PATENT DOCUMENTS

| | | |
|---|---|---|
| 195434 | 8/1906 | Fed. Rep. of Germany . |
| 198375 | 5/1907 | Fed. Rep. of Germany . |
| 239992 | 4/1911 | Fed. Rep. of Germany . |
| 135103 | 3/1978 | Fed. Rep. of Germany . |

*Primary Examiner*—David H. Corbin

*Attorney, Agent, or Firm*—Allegretti, Newitt, Witcoff & McAndrews, Ltd.

[57] ABSTRACT

Process and device for sealing barrier constructions in subterranean galleries, especially in salt mines. In the process, a fluid sealing medium is filled into a hollow space and is maintained at overpressure relative to the pressure of a stressing medium. With the device, a hollow space is filled with a sealing medium, maintained below overpressure, and positioned between the part of the gallery to be protected and the part of the galley in which a stressing medium is present. The sealing medium is stressed with a preset pressure and at the pressure of the stressing medium. The hollow space has a pressure shaft, in which the sealing medium stands at a predetermined level. The part of which is located above the level of the sealing medium is connected with the gallery in which the stressing medium stands. Through this, it is ensured that a specific overpressure is always present in the hollow space. Losses of sealing medium are independently compensated through the column of sealing medium in the pressure shaft, which represents a supply of pressure medium.

31 Claims, 2 Drawing Figures

SYSTEM FOR SEALING BARRIER CONSTRUCTIONS IN SUBTERRANEAN GALLERIES

BACKGROUND OF THE INVENTION

The invention concerns a process and a device for sealing barrier constructions in subterranean galleries, especially in salt mines.

In subterranean mining, the task of sealing hollow spaces relative to a stressing medium, which can be either fluids or gasses, falls to the transversal seals. In horizontal mines, these seals are referred to as barriers or barrier constructions. Through this, both the static, as well as the sealing, function is assigned to the barrier construction material. As to tightness, failures occur frequently, especially in potash and rock salt mining. This can be attributed primarily to the fact that, with conventional transversal seals connected with the mine, crack formations arise in the contact area between the barrier and the mine. The crack formations are due to excessive tensile tensions.

In the case of an imperfect (i.e., permeable) contact between the tight barrier body and the tight mine, the tightness is attained by means of additional sealing elements or sealing measures.

Additional sealing elements may be either a ring seal, for sealing the contact zone on the circumference of the barrier body, or a surface seal, for sealing the entire cross-section, including the contact zone.

As to the physical contact mechanism of the sealing medium, there are different types of seals. Some seals use the pure adhesion effect and other seals use the overpressure effect.

With seals using the pure adhesion effect, the sealing agent may hold and seal in a solid form, such as, for example, bitumen or plastic tracks and/or metal foils. The seals may also hold and seal in plastic to viscous form, such as, for example, clay, bitumen, or a sand asphalt. Such seals hold and seal by means of adhesion effects to the, and its own substance tightness between the, impermeable static solid bodies to be sealed. Differential movements between barrier bodies and mines as a consequence of the static load absorption and load diminution through the blocking construction can impair the adhesive sealing effect. Thus, local or zonal mechanical overstressings of the (originally tight) static support impair the effect of sealing.

Under high mechanical stressing, high fluid pressure, or steep pressure gradients, as well as under strong deformations or differential movements under loads, sealing systems may work in a purely adhesive manner. Such sealing systems can therefore lose their effectiveness under the influence of different damage mechanisms.

In the seals which operate through overpressure, the sealing media stand in solid form, such as, for example, bitumen, under overpressure relative to the pressure of the sealing, fluid, or gaseous stressing medium. This overpressure prevents the penetration of the medium into the contact joints. Adhesion properties of the sealing material may also support this sealing mechanism.

Such a sealing retains its effectiveness if, and as long as, this overpressure operates.

The overpressure of this type of sealing relative to the pressure of the media to be sealed can be produced through mechanically working elements, such as, for example, hydraulic cylinders, hydrostatic overpressure effects, and physical-chemical effects, through sources under overpressure.

Special problems result with sealing in the salt mines, since seepage occurs in the mine through the exchange of substances between salt brine and the mine.

DE-PS No. 195 434 depicts a barrier seal, especially for salt mines, in which the shaft or the gallery is covered before the barrier door with tubbing or brickwork. The barrier door itself lies with its frame against a wedging collar. The sealing in the contact area between the wedging collar and the mine is accomplished through picotages. The space between the tubbing and the mine is filled up with cement. In the cement behind the tubbings or the brickwork, air chambers are formed which are provided as support and pressing chambers, and allow checking of the value and reliability of the seal or the sealing between the cement and the mine. If it should so happen that, for example, the water blocked out is infiltrating as the result of hair-line cracks, then the chambers can be filled with cement in order to again produce a flawless sealing. There is further constructed a system of tubbing, in order to create a new observation chamber. It is disadvantageous that a lasting seal cannot be attained with the standing of incompletely saturated salt solutions as a consequence of back-rinsings from the picotages.

From DE-PS No. 198 375, there is known a mine blocking device for cross-cuttings or galleries in mineral salt or potash salt or the like, or in other soluble mining layers. In order to prevent the barrier position from becoming loose from the water standing behind the barrier to the submerged mining space, so that the salt mine disintegrates and can no longer be maintained, one or several pipe tubings are provided from the surface. Using the tubings, a space sealed between two barriers or barrier doors is filled with a saturated solution of such salts as stand in the transversal cut or the gallery, and are kept under pressure. Through this, it should be recognized that only saturated solutions can flow out through the existing cracks from the submerged and the protected mining space, and can thereby not enlarge the existing cracks. Since, however, the internal intrados of the barrier nonetheless comes into contact with the unsaturated penetration solution, the danger of seepage exists.

Through DE-PS No. 239 992, there are known a process and device for securing mine spaces to be protected against the submerged mine spaces of a salt mine. In order to create a sealing, a cushion of a gaseous or fluid body, which is indifferent to salts, is provided between a barrier door and the water or the brine. Air is suggested as a gas, and oil is suggested as a fluid. A compressor provides for the maintenance of the air cushion. Since sealing, relative to gas pressure, is extraordinarily difficult, and since in either level or slightly inclined galleries, the gas cushion, because of the varying densities of air and salt brine, is not mounted over the entire cross-section, an adequate sealing cannot be attained.

DD-PS No. 135 103 concerns a process for sealing galleries in soluble mine layers. There is positioned before the static support a hollow space section with material which is inert relative to the salt mine (for example, bitumen), and then buffer lye, which is supersaturated relative to the salt mine. Convection and diffusion are kept slight through the filling out of the hollow, cross-sectional space with heaps of debris and blocking walls, and with displaced openings. The possibility of saturation exists with the unsaturated lye. Through the positioning of an overpressure space, which is filled with a material (silicon oil) which is inert relative to the mine and the bitumen, a penetration of the lye into the area of the sealing packagings is impeded, as long as the overpressure can be maintained. From the air side, pressure measurements, sample extractions, and extrusion of buffer lye are undertaken through pipe tubings, and extrusions are carried out, and an overpressure relative to the lye pressure is produced. In order to rule out the appearance of dissolutions, a long hollow space section with a thrust space insulation is provided. This is not completely brought forward to the static support, so that the possibility of sealing the extruding mine area does not occur in the sealing medium. In order to impede or limit the back-creeping of the thrust insulation, the insulation is bound several times in radially running direction slits, which are extruded with plastic. It is disadvantageous that the overpressure in the sealing system must always be adjusted to the pressure of the standing interference media. Such adjustments require the aid of pumps, which are not maintenance-free, cannot maintain the necessary pressure, and cannot be used as long as the barrier is accessible from one side.

SUMMARY OF THE INVENTION

An object of the present invention is an improved system for sealing barrier constructions in subterranean galleries, especially in salt mines. Another object is a process and device of the type already stated that attains, both for normal loads, as well as pressure loads, a self-operating and maintenance-free sealing, with a very long life span.

This object is obtained through the form of the invention in accordance with the following claims.

In the claimed process, a fluid sealing medium is filled into a hollow space and is maintained at overpressure relative to the pressure of a stressing medium. The present invention further relates to a device for sealing such barrier constructions. With the present device, a hollow space is filled with a sealing medium, maintained below overpressure, and positioned between the part of the gallery to be protected and the part of the galley in which a stressing medium is present. The process and the device should be so constructed that a maintenance-free and self-operating sealing is attained for any load level. For this, the sealing medium is stressed with a preset pressure and at the pressure of the stressing medium. The hollow space has a pressure shaft, in which the sealing medium stands at a predetermined level. The part of which is located above the level of the sealing medium is connected with the gallery in which the stressing medium stands. Through this, it is ensured that a specific overpressure is always present in the hollow space. Losses of sealing medium are independently compensated through the column of sealing medium in the pressure shaft, which represents a supply of pressure medium.

Through the solution of the stated tasks in accordance with the present invention, it is ensured that a sealing medium overpressure is always present relative to pressure stressings of a stressing medium (fluid and/or gas), as well as, in the case of lower as well as higher pressure stressing, through the stressing medium. According to the invention, the pressure in the sealing system between the pressure shaft and the stressing medium changes directly with the pressure of the stressing medium, so that an adequate overpressure which is always self-regulating is adjusted. The use of pumps is superfluous. The overpressure provided can therefore be maintained for long periods. Losses of sealing medium, for example, through displacement of support, the formation of cracks, and so forth, which are also still favored through temperature-controlled reactions of viscosity, can then independently be compensated for. The compensation is made through the column of sealing medium in the shaft, which represents a supply of sealing medium. Consequently, in accordance with the present invention, the functioning of the sealing at the decisive contact points between barrier construction and the mine is maintained. In this manner, the invention creates an inherently secure sealing system.

Further advantageous and suitable developments of the solution of the task in accordance with the invention are set out in the following claims.

BRIEF DESCRIPTION OF THE DRAWING

The invention shall be further described by means of the attached illustration, in which are depicted examples of execution. These depict the following.

DETAILED DESCRIPTION OF THE PREFERRED EMBODIMENT

Figure 1:
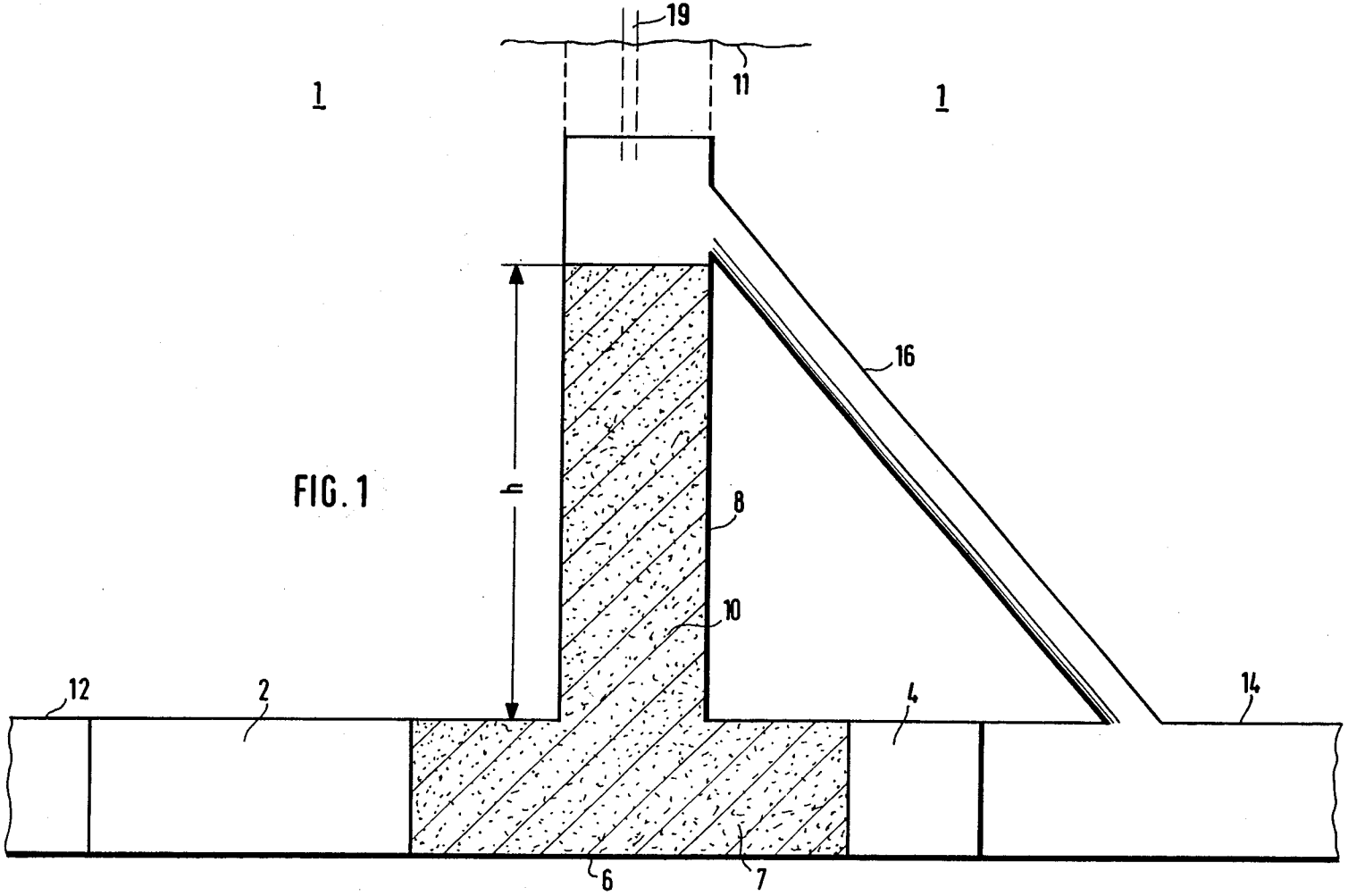
FIG. 1 is a schematic showing a first preferred embodiment of the present invention with a variant depicted by dotted lines.
Figure 2:
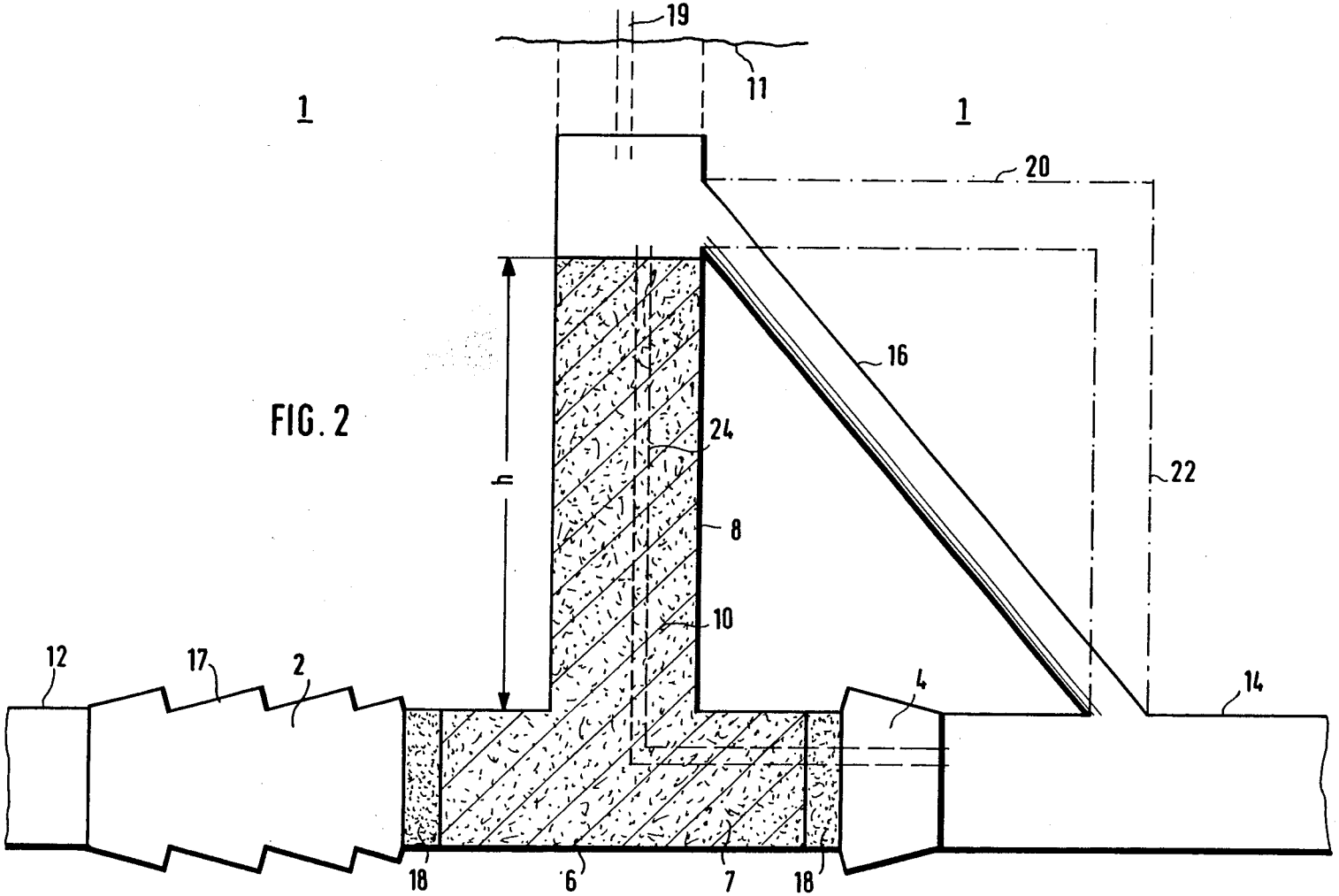
FIG. 2 is a schematic showing a second preferred embodiment of the invention shown in FIG. 1, with modifications.

The illustration of FIGS. 1 and 2 depicts the device for sealing barrier constructions in subterranean galleries, especially in salt mines. The device includes between a stationary (static) support 2 and an auxiliary barrier 4, a hollow space 6, which is filled with a fluid to viscous sealing medium 7. The device also has a pressure shaft, in which a column of sealing medium 10 stands up to the level of h. The pressure shaft 8 is formed, above, in a closed manner.

The static support 2 is located on the side of the hollow space 6 which is turned to the part of the gallery 12 to be protected, and the auxiliary barrier 4 seals the hollow space 6 against the gallery 14 with the stressing medium fluid and/or gas. The static support 2 and auxiliary barrier shall both be referred to herein as primary seals.

The part of the pressure shaft which is located above the column of sealing medium 10 is connected, via a connecting boring 16, to the part of the gallery with the stressing medium 14.

The static support 2 in accordance with FIG. 1 is constructed as a parallel support which is connected with the mine. The auxiliary barrier is constructed as a parallel barrier which is connected with the mine. Other known transversal forms of the support and of the auxiliary barrier, such as the single or multiple truncated conical form, or cogged, etc., are likewise possible.

Essentially, any type of construction is possible which is able to absorb the pressure stresses which appear in the mine and the gasses or fluids, and to displace these to the surrounding mine.

FIG. 2 shows, for example, a static support for gas or fluid pressure stressings of approximately 100 bar in four-fold truncated conical construction form, which is connected with the mine in a force-locking or form-locking manner. The support can, for example, have a length of approximately 13 m, and be constructed as a concrete construction form.

The auxiliary barrier can, for example, because of the slight pressure stress through the sealing medium, be constructed as a single truncated cone form, and connected in a force-locking or form-locking manner with the mine. It can have, for example, a length of approximately 4 m, and likewise be constructed of concrete.

In the case of a form-locking connection, a sliding layer 17 of asphalt plates can be provided between support or auxiliary barrier and the mine.

In order to minimize the loss of sealing medium through penetration of sealing medium into the contact joints between the support or auxiliary barrier and the mine, there can be provided on the hollow space side, both on the static support as well as on the auxiliary barrier, transversal sealings 18 of sand asphalt, as is schematically depicted in FIG. 2.

The device depicted in the diagram for the sealing works in the following manner.

In the case of a normal load, if no pressure stressing develops through a standing stressing medium, the sealing medium in the hollow space 6 between the static support 2 and the auxiliary barrier 4 stands under overpressure, which yields from the hydrostatic pressure of the sealing medium column 10 of the level h, and is represented by the following equation:

$$P_U = \S_D \cdot h \cdot g \quad (1)$$

where $P_U$=overpressure;

$\S_D$=density of the sealing medium;

h=the level of the column of the sealing medium;

g=acceleration due to gravity.

This overpressure $P_U$ also corresponds to the macimal differential pressure over the auxiliary barrier, which is statically exposed to this corresponding differential pressure.

The pressure shaft 8 and the gallery 14 for the stressing medium form, via the connecting boring 16, a system of a type of communicating tubes. If the gallery part 14 is filled with stressing fluid, and the fluid pressure $P_O$ increases, then the fluid, dependent on the level of this pressure in the connecting boring 16, is greatly pressured, and is pressed into the pressure shaft. It exets there a pressure which is reduced relative to the pressure $P_O$ by $\Delta P = \S_F \cdot h \cdot g$ on the column of sealing medium. The resulting absolute pressure $P_a$ in the sealing medium 7 on the auxiliary barrier 8 then amounts to:

$$P_a = P_O - \Delta P + P_U.$$

An overpressure arises which is reduced, relative to the overpressure cited above in equation (1), for the normal load by the hydrostatic pressure of the stressing fluid column with the level h in the connecting boring 16. The overpressure is independent of the level of the fluid pressure in the event of pressure $P_O$, and thus is self-regulating via the auxiliary barrier, differential pressure, or the hollow space 6. This level of overpressure $P_{UL}$ is derived from the equation:

$$P_{UL} = h \cdot (\S_D - \S_F) \cdot g, \quad (2)$$

where $\S_F$=the density of the fluid.

If the stressing medium is a gas, then an overpressure $P_{UL}$ results:

$$P_{UL} = h \cdot (\S_D - \S_G) \cdot g, \quad (3)$$

where $\S_G$=the density of the gas.

In order to always have an overpressure in the load, $\S_D > \S_F$ and $> \S_G$ is selected.

If the pressure of the stressing fluid is not so great that the fluid is pressed into the pressure shaft, then an overpressure is adjusted. The overpressure is reduced, relative to the overpressure in the normal case, without pressure stressing, through a stressing fluid by the hydrostatic pressure yielded from the standing level $h_F$ of the fluid in the connecting boring 16:

$$P_F = h_F \cdot \S_F \cdot g. \quad (4)$$

The overpressure for this case therefore comes out to:

$$P_{UL} = P_U - P_F = g\,(h \cdot \S S_D - h_F \cdot \S_F). \quad (5)$$

In equation (5), $P_{UL}$ is positive for:

$$h \cdot \S_D > h_F \cdot \S_F.$$

It should be recognized that the distance of the discharge of the connecting boring into the pressure shaft for stressing fluid to the level of the sealing medium in the pressure shaft 8 should not be so great that $h \cdot \S_D \leqq h_F \cdot \S_F$. In such a case, the differential pressure of 0 arises over the auxiliary barrier or an underpressure in the hollow space 6, through which the sealing effect of the sealing device is reduced.

In gaseous stressing media, there always applies practically the same as in equation (1).

If sealing medium losses should occur, for example, through displacement of supports in stressing, or through penetration of sealing medium into cracks or the like, so that losses are still caused through temperature-conditioned viscosity reductions, then these are equalized by the column of sealing medium 10. The column of sealing medium 10 forms a supply of sealing medium, which is independently equalized. The sealing device described is therefore especially suited for permanent storage mines, in which increased temperatures form the heat of decomposition must be anticipated. The maintenance of a sealing device is therefore not necessary. This is particularly important under circumstances where a mine is no longer accessible.

To further increase the security of the sealing device, additional tube pipings 19 (FIG. 1) for filling with sealing medium in the pressure shaft, especially during the time of accessibility of the barrier construction, are provided. Such pipe tubings are not necessary.

Fluid to viscous substances, such as, for example, bitumen and asphalt, are used as sealing media.

Asphalts of standard bitumen and limestone dust filler (density: 1.4 t/m$^3$) or barium suifate dust filler (density: 2.3 t/m$^3$) are used as sealing media, whereby the desired asphalt density can be adjusted through a corresponding filler additive between the two values named.

The density of a saturated salt solution depends on the composition, and can lie within the order of size of 1.35 t/m$^3$.

If one selects an overpressure, for example, of $P_U$ about 5 bar, then the level h of the column of sealing medium (density of the asphalt, for example: 1.8 t/m$^3$)

amounts to approximately 29 m. From this, there results an overpressure $P_{UL}$ in the stressing through fluids (density: 1.35 t/m$^3$) of approximately 1.3 bar. In the case of the pressure stressing through gasses, there practically applies, because of the low density of gasses, $P_U = P_{UL}$.

The pressure shaft 8 is represented in the diagram as a shaft closed from above. It can be as high as desired, and also be connected with the surface of the earth 11, as indicated by dotted lines in FIG. 1. The pressure shaft can be carved out or can be constructed from a pipe. A casing is especially effective in leading to the surface.

The diameter of the pressure shaft can be selected as desired. It is essentially determined through the losses of sealing medium which are anticipated. The influence of the losses of sealing medium on the height of the column of sealing medium h decreases with increasing diameter. The diameter can, for example, amount to 3 m.

The connection between the pressure shaft 8 and the gallery part 14 can also, as described above, be constructed, apart from the boring 16. Such alternative connections are labels as galleries 20 and shafts 22 and shown in the form of dotted lines in FIG. 2.

The connection, whether constructed as a boring or as a gallery and shaft, can—like the shaft—be either excavated or tubed.

The connection between the upper part of the pressure shaft and the gallery part 14 can take place outside; through a boring 16; or through a shaft 20 and a gallery 22; or through a pipe connection 24 (depicted by dotted lines in FIG. 2) from the gallery part 14 through the auxiliary barrier 4, through the hollow space 6, and the shaft 8, up to the part of the shaft which is located above the level of the column of sealing medium 10.

I claim:

1. A process for sealing a barrier construction in a subterranean gallery, said gallery including a stressing medium that applies pressure within the gallery and wherein said gallery includes a hollow space, comprising:

filling the hollow space with a fluid sealing medium;

maintaining the fluid sealing medium at an overpressure relative to the pressure of the stressing medium; and stressing the sealing medium with a predetermined pressure and with the pressure exerted by the stressing medium.

2. A process in accordance with claim 1 wherein the predetermined pressure is produced by the hydrostatic pressure of a sealing medium column.

3. A device for sealing a barrier construction in a subterranean gallery, said gallery including a stressing medium that applies pressure within the gallery and a hollow space, comprising, in combination:

a fluid sealing medium substantially filling said hollow space and maintained at an overpressure relative to the pressure of the stressing medium, said fluid sealing medium positioned between a part of the gallery to be protected and another part of the gallery in which the stressing medium stands;

a pressure shaft interconnected to said hollow space, said fluid sealing medium standing at a predetermined level within said pressure shaft and an upper portion of said pressure shaft located above the level of the fluid sealing medium; and an interconnection between said upper portion of said pressure shaft and said part of said gallery holding said stressing medium.

4. A device in accordance with claim 3 further comprising primary seals, wherein the hollow space on the side adjacent to the part of the gallery to be protected is bounded by a static support, and the opposite side of the gallery, which faces the stressing medium, is bounded by an auxiliary barrier.

5. A device in accordance with claim 4 wherein the static support substantially absorbs the overall static load of said device.

6. A device in accordance with claim 4 wherein the auxiliary barrier substantially absorbs the maximum differential pressure between the pressure in the hollow space and the pressure in the part of the gallery which is built for the stressing medium.

7. A device in accordance with claim 4 wherein the static support includes a truncated conical support, which is connected with the gallery.

8. A device in accordance with claim 5 wherein the static support includes a truncated conical support, which is connected with the gallery.

9. A device in accordance with claim 4 wherein the auxiliary barrier includes a truncated conical support barrier which is connected with the gallery.

10. A device in accordance with claim 6 wherein the auxiliary barrier includes a truncated conical support barrier which is connected with the gallery.

11. A device in accordance with one of the claims 4 or 5 or 6 or 7 or 8 or 9 or 10, wherein a sliding layer is provided with a form-locking connection between one of the primary seals and the gallery.

12. A device in accordance with one of the claims 4 or 5 or 6 or 7 or 8 or 9 or 10 further comprising additioned transversal seals for blocking the penetration of sealing medium into contact joints, said transversal seals positioned on the side of the hollow space at one of the primary seals.

13. A device in accordance with claim 11 further comprising additional transversal seals for blocking the penetration of sealing medium into contact joints, said transversal seals positioned on the side of the hollow space at one of the primary seals.

14. A device in accordance with claim 3 wherein the upper end of the pressure shaft is constructed in a closed manner.

15. A device in accordance with claim 3 further comprising a channel for connecting the pressure shaft part, which is located above the column of sealing medium, and the gallery for the stressing medium.

16. A device in accordance with claim 15 wherein the connecting channel is an inclined, connecting boring.

17. A device in accordance with claim 3 further comprising a pipe connection, laid from the gallery through the auxiliary barrier, the hollow space, and the shaft, to above the sealing medium column, whereby the part of the pressure shaft located above the column of the pressure medium is interconnected with the stressing medium gallery.

18. A device in accordance with claim 3, wherein the sealing medium has a greater density than the stressing medium.

19. A device in accordance with claim 3 wherein the pressure shaft includes an extension up to the surface of the earth.

20. A device in accordance with claim 13 wherein the pressure shaft includes an extension up to the surface of the earth.

21. A device in accordance with claim 19 wherein the connecting channel issues into the pressure shaft at about the height of the sealing medium.

22. A device in accordance with claim 20 wherein the connecting channel issues into the pressure shaft at about the height of the sealing medium.

23. A device in accordance with claim 21 wherein the connecting channel is an inclined, connected boring.

24. A device in accordance with claim 22 wherein the connecting channel is an inclined, connecting boring.

25. A device in accordance with claim 14 or 15 or 16 or 3, further comprising a casing for the pressure shaft and connecting channels.

26. A device in accordance with claim 19 further comprising a casing for the pressure shaft and connecting channels.

27. A device in accordance with claim 20 further comprising a casing for the pressure shaft and connecting channels.

28. A device in accordance with claim 21 further comprising a casing for the pressure shaft and connecting channels.

29. A device in accordance with claim 22 further comprising a casing for the pressure shaft and connecting channels.

30. A device in accordance with claim 23 further comprising a casing for the pressure shaft and connecting channels.

31. A device in accordance with claim 24 further comprising a casing for the pressure shaft and connecting channels.

* * * * *